US010598458B1

(12) United States Patent
Cler et al.

(10) Patent No.: US 10,598,458 B1
(45) Date of Patent: Mar. 24, 2020

(54) SUPPRESSED MUZZLE BRAKE

(71) Applicant: U.S. Government as Represented by the Secretary of the Army, Picatinny Arsenal, Dover, NJ (US)

(72) Inventors: Daniel L. Cler, Coatesville, PA (US); Gregory S. Oberlin, Stewartstown, PA (US); Eric A. Binter, Sussex, NJ (US)

(73) Assignee: The United States of America as Represented by teh Secretary of the Army, Washington, DC (US)

( * ) Notice: Subject to any disclaimer, the term of this patent is extended or adjusted under 35 U.S.C. 154(b) by 0 days.

(21) Appl. No.: 16/140,986

(22) Filed: Sep. 25, 2018

Related U.S. Application Data

(60) Provisional application No. 62/595,782, filed on Dec. 7, 2017.

(51) Int. Cl.
*F41A 21/36* (2006.01)

(52) U.S. Cl.
CPC ..... *F41A 21/36* (2013.01)

(58) Field of Classification Search
CPC ..... F41A 21/30; F41A 21/325
USPC ..... 89/14.4, 14.05; 181/223; 29/428
See application file for complete search history.

(56) References Cited

U.S. PATENT DOCUMENTS 4,207,799 A * 6/1980 Tocco ..... F41A 21/325 89/14.3
4,374,484 A * 2/1983 Bekker ..... F41A 21/38 89/14.3
4,429,614 A * 2/1984 Tocco ..... F41A 21/36 89/14.3
4,879,942 A * 11/1989 Cave ..... F41A 21/36 89/14.3
5,076,137 A * 12/1991 Paredes ..... F41A 21/36 89/14.3
7,353,741 B2 * 4/2008 Brixius ..... F41A 13/06 42/90
7,581,482 B1 * 9/2009 Cler ..... F41A 21/36 89/14.3
7,891,284 B1 * 2/2011 Barrett ..... F41A 5/28 89/14.4
7,905,171 B1 * 3/2011 Brittingham ..... F41A 21/30 89/14.4
8,286,750 B1 * 10/2012 Oliver ..... F41A 21/30 181/223
8,297,174 B1 * 10/2012 Russell ..... F41A 25/12 89/37.14
8,326,585 B1 * 12/2012 Cler ..... G06F 17/5018 703/2

(Continued)

*Primary Examiner* — Michael D David
(74) *Attorney, Agent, or Firm* — Michael C. Sachs

(57) ABSTRACT

A suppressed muzzle brake for automatic and semi-automatic weapons provides mitigation of recoil, muzzle climb and increased sound pressure levels while overcoming the deleterious effect of increased blast overpressure on the shooter. The suppressed muzzle brake includes a plurality of suppressor baffles for providing quick blowdown of the weapon and some muzzle brake function, a baffle brake which redirects the propellant gas in a direction and manner so as not to increase blast overpressure to unsuitable levels. In addition, openings in a can of the suppressed muzzle brake provide a compensator effect by inducing a downward force on the suppressed muzzle brake.

6 Claims, 7 Drawing Sheets

(56) References Cited

U.S. PATENT DOCUMENTS

| | | | | |
|---|---|---|---|---|
| 8,561,757 | B1 * | 10/2013 | Edsall | F41A 21/30 181/223 |
| 8,567,300 | B1 * | 10/2013 | Cler | F41A 13/08 89/1.2 |
| 8,820,473 | B1 * | 9/2014 | White | F41A 21/34 181/223 |
| 8,826,579 | B2 * | 9/2014 | Lippard | B23D 77/14 42/76.1 |
| 9,347,727 | B1 * | 5/2016 | Cler | F41A 21/30 |
| 10,088,261 | B1 * | 10/2018 | Oglesby | F41A 21/34 |
| 10,422,604 | B2 * | 9/2019 | Niswander | F41A 3/66 |
| 2006/0123983 | A1 * | 6/2006 | Vais | F41A 21/30 89/14.3 |
| 2010/0287810 | A1 * | 11/2010 | Kleppe | F16M 11/28 42/94 |
| 2013/0276341 | A1 * | 10/2013 | Wells | F41G 11/003 42/71.01 |
| 2015/0211820 | A1 * | 7/2015 | McRee | F41A 11/02 42/16 |
| 2015/0308778 | A1 * | 10/2015 | Vossler | F41A 21/36 89/14.3 |
| 2015/0323275 | A1 * | 11/2015 | Lessard | F41A 21/34 89/14.4 |
| 2017/0205178 | A1 * | 7/2017 | Niswander | F41A 21/36 |
| 2018/0340749 | A1 * | 11/2018 | Palu | F41A 21/30 |
| 2019/0078852 | A1 * | 3/2019 | Peknik | F41A 21/30 |

* cited by examiner

SUPPRESSED MUZZLE BRAKE

CROSS REFERENCE TO RELATED APPLICATIONS

This application claims benefit under 35USC119 (e) from provisional application 62/595,782 filed Dec. 7, 2017 entitled "Suppressed Muzzle Brake" by the same inventors and commonly assigned, the entire file wrapper contents of which are hereby incorporated by reference as though fully set forth.

U.S. GOVERNMENT INTEREST

The inventions described herein may be made, used, or licensed by or for the U.S. Government for U.S. Government purposes.

BACKGROUND OF INVENTION

The invention relates in general to weapon systems and in particular to small caliber weapon systems.

High energy, high pressure small caliber weapons require means to mitigate recoil, muzzle climb and increased sound pressure levels. However, efforts taken to mitigate one variable may adversely affect others. For example, muzzle brakes reduce the overall impulse of the weapon system by redirecting the propellant gases in the barrel after the projectile exits the weapon. However, the muzzle brake redirects these gases to the rear, which can increase the blast overpressure on the soldier. If the blast overpressure exceeds allowable limits for the shooter, this may be an issue.

Accordingly, a need exists for the capability to simultaneously mitigate recoil, muzzle climb and increased sound pressure levels. Such a system would provide significant braking while at the same time overcoming the deleterious effect of increased blast overpressure on the shooter.

BRIEF SUMMARY OF INVENTION

One aspect of the invention is a suppressed muzzle brake which comprises a plurality of baffles for suppressing the propellant gases with a by-pass system and a brake baffle for redirecting propellant gases rearward.

In another aspect of the invention, a suppressed muzzle brake also comprises a plurality of suppressor baffles for suppressing the propellant gases with a by-pass system and a brake baffle for redirecting propellant gases rearward. Here, the plurality of suppressor baffles and the brake baffle are contained by a suppressor can having openings on the top and sides of the distal end of the suppressor can to provide a net downward force on the suppressed muzzle brake in operation.

OBJECTS OF THE INVENTION

Accordingly, it is an object of the present invention to provide an improved suppressed muzzle brake for a weapon held by a shooter.

Another object of the present invention is to provide a suppressed muzzle brake for a weapon with directed vents at the muzzle brake distal end, to reduce blast overpressure experienced by a shooter.

It is a further object of the present invention to provide a suppressed muzzle brake for a weapon with directed vents at the muzzle brake distal end, to produce a counter recoil force upon the weapon.

It is yet another object of the present invention to provide a suppressed muzzle brake for a weapon with directed vents at the muzzle brake distal end, which will tend to counter muzzle climb of the weapon.

It is a still further object of the present invention to provide a suppressed muzzle brake for a weapon with directed vents at the muzzle brake distal end, to reduce ground obscuration in firing by lessening the tendency to kick up dust.

It is a still another object of the present invention to provide a suppressed muzzle brake for a weapon with a brake baffle having directed vents at the muzzle brake distal end, to even more effectively reduce blast overpressure experienced by a shooter.

These and other objects, features and advantages of the invention will become more apparent in view of the within detailed descriptions of the invention, the claims, and in light of the following drawings and/or tables wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

Figure 5A:
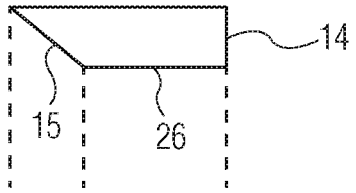
Figure 5B:
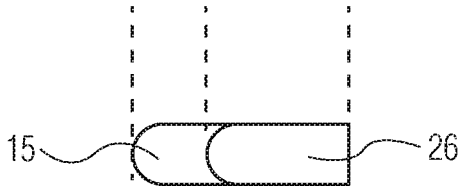
Figure 5C:
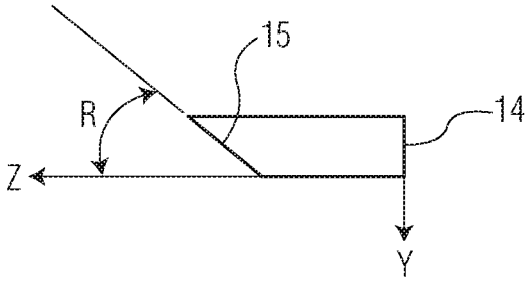

FIG. 5A shows a cross section of vent opening 14; FIG. 5B shows a top view of vent opening 14; and, FIG. 5C shows another cross section of vent opening 14.

Figure 6:
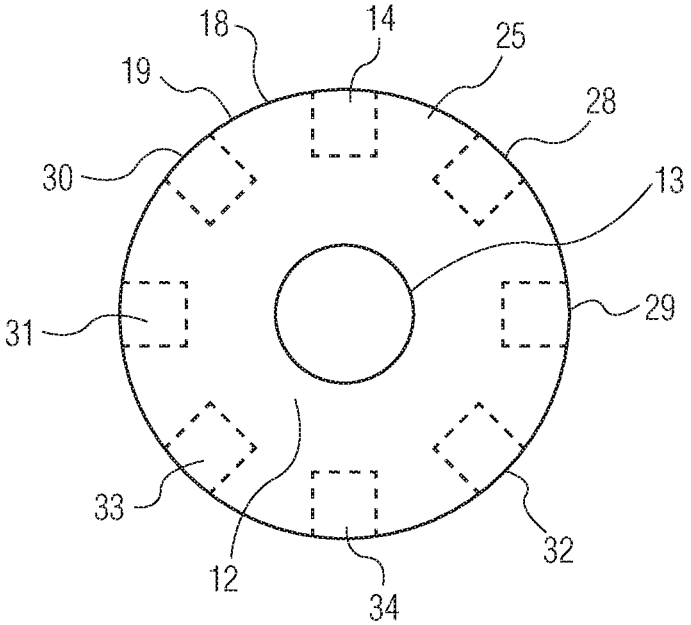

FIG. 6 shows an end view of cap 12 of the suppressed muzzle brake assembly.

Figure 7A:
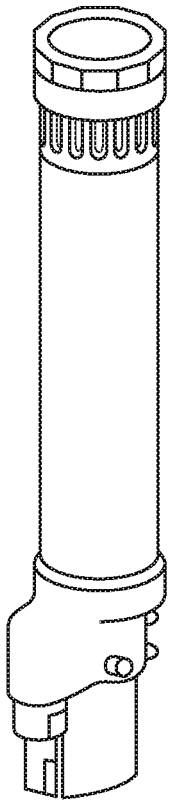
Figure 7B:
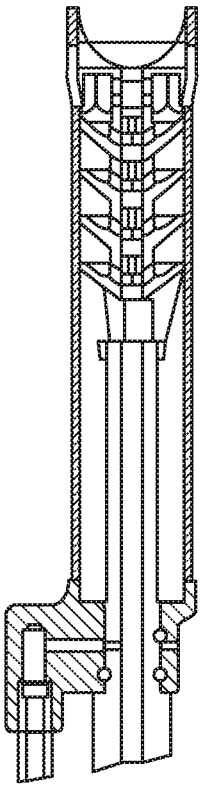
Figure 7C:
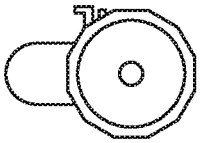
Figure 7D:
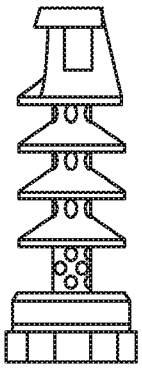
Figure 7E:
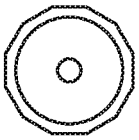
Figure 7F:
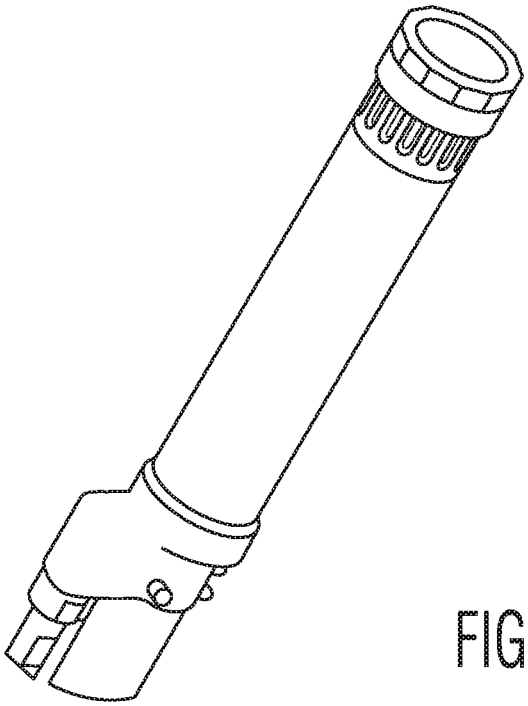
Figure 7G:
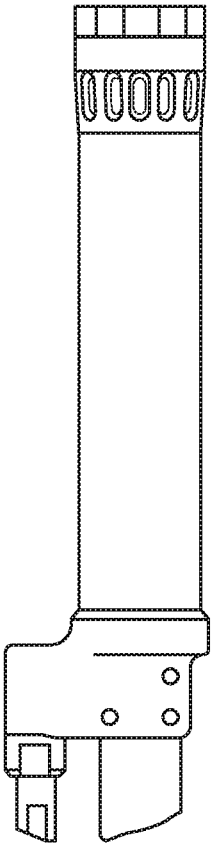
Figure 7H:
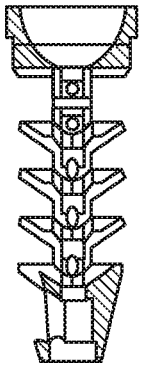

FIG. 7A shows a top down isometric view of the suppressed muzzle brake in accordance with this invention; FIG. 7B shows a cross-sectional view of the suppressed muzzle brake in accordance with this invention; FIG. 7C is an end view, from the muzzle end, of the suppressed muzzle brake in accordance with this invention; FIG. 7D is an exterior view of the baffle brake elements located within the muzzle end of the suppressed muzzle brake in accordance with this invention; FIG. 7E is an end view, from the muzzle end, of the baffle brake elements shown in FIG. 7D hereof; FIG. 7F is a right leaning, top down isometric view of the suppressed muzzle brake in accordance with this invention;

FIG. 7G is a front view of the suppressed muzzle brake in accordance with this invention, and; FIG. 7H is a cross-sectional view of the baffle brake elements located within the muzzle end of the suppressed muzzle brake in accordance with this invention.

DETAILED DESCRIPTION OF THE INVENTION

A suppressed muzzle brake for automatic and semi-automatic weapons provides mitigation of recoil, muzzle climb and increased sound pressure levels while overcoming the deleterious effect of increased blast overpressure on the shooter. The suppressed muzzle brake includes a plurality of suppressor baffles for reducing blast overpressure of the weapon and some muzzle brake function, a baffle brake which redirects the propellant gas in a direction and manner so as not to increase blast overpressure to unsuitable levels. In addition, openings in a can of the suppressed muzzle brake provide a compensator effect by inducing a downward force on the suppressed muzzle brake. This application hereby incorporates by reference, U.S. Pat. No. 9,347,727 entitled "Automatic Weapon Suppressor" by Daniel L. Cler, as though fully set forth.

Figure 1:
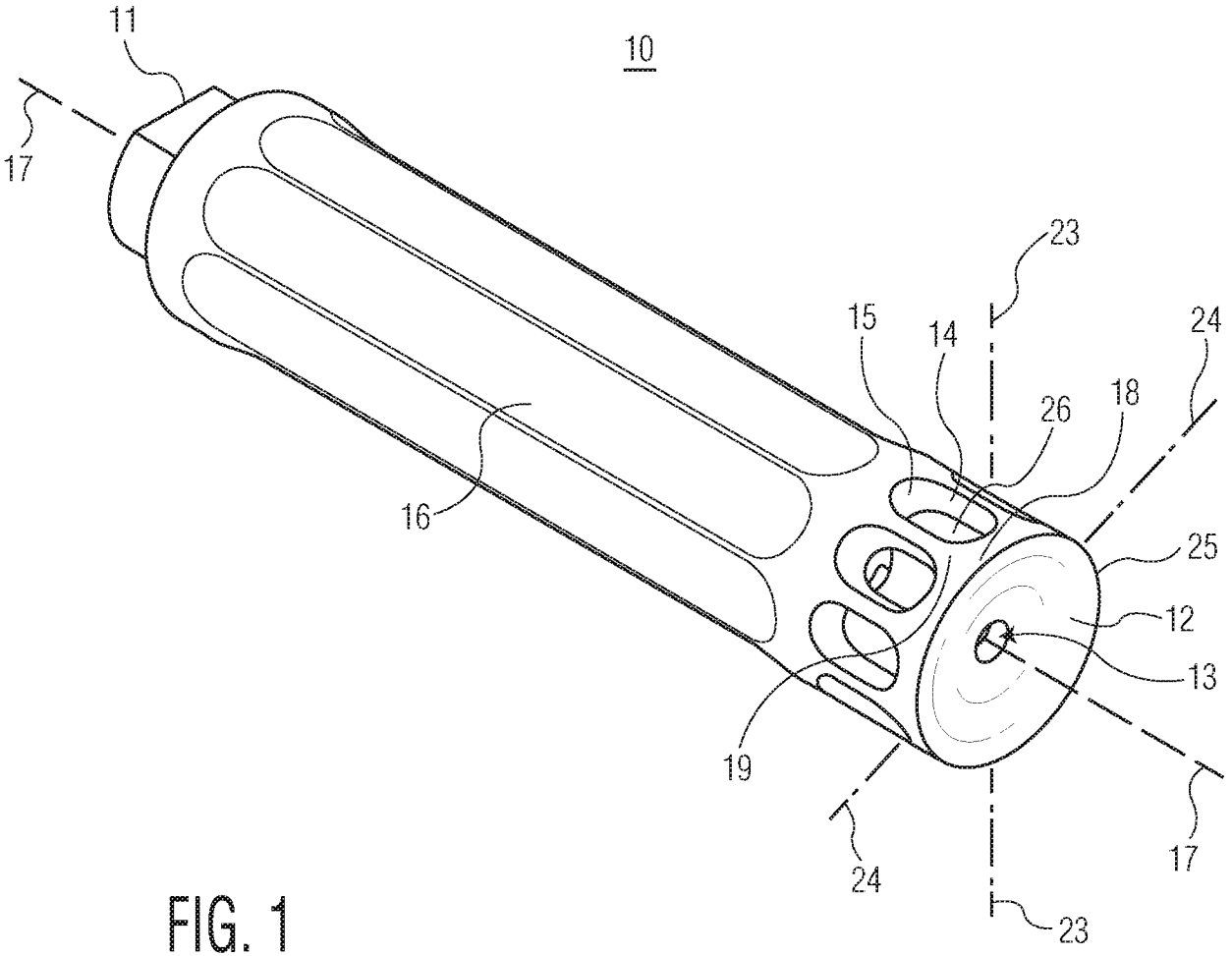
FIG. 1 shows a front left perspective view of a suppressed muzzle brake, in accordance with this invention.
Figure 2:
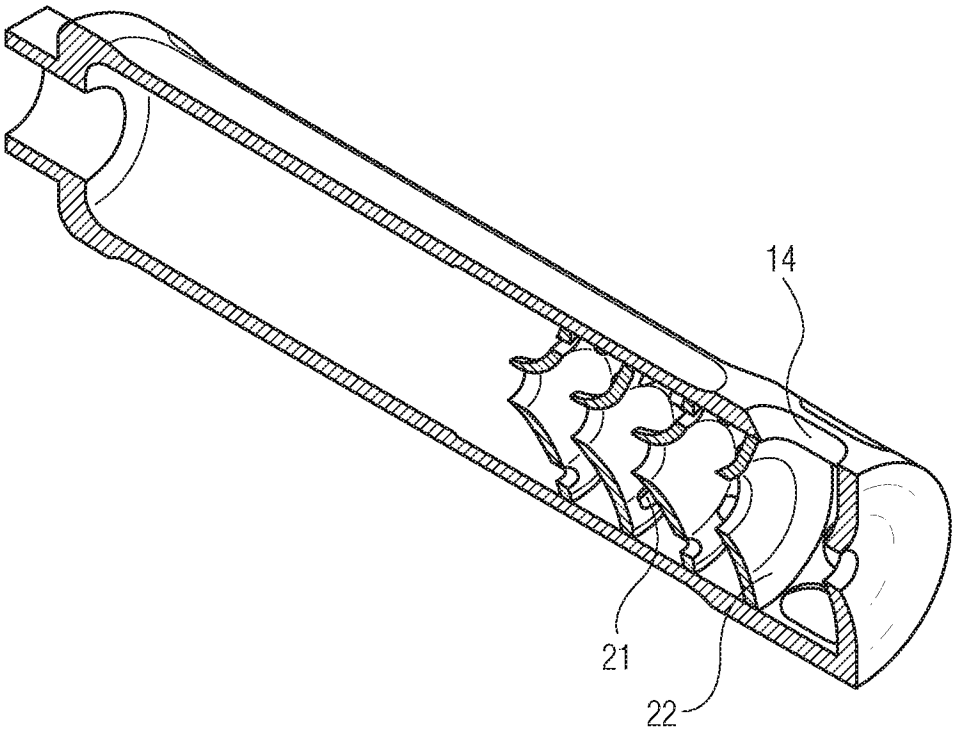
FIG. 2 shows a cross-sectional front left perspective view of a suppressed muzzle brake, in accordance with this invention.

FIG. 1 shows a front left perspective view of a suppressed muzzle brake 10 and FIG. 2 a cross-sectional front left perspective view of a suppressed muzzle brake, in accordance with an embodiment of the invention. The muzzle brake has smooth surfaces 16 on its exterior surface. FIG. 2 shows various views of a portion of a barrel and a suppressed muzzle brake, in accordance with an embodiment of the invention. The suppressor may be secured at 11 to a distal end of a barrel of a weapon and may be formed to have a body portion, or 'can', having a bore axis 17 extending concentric with an axial bore axis of the barrel when the suppressor is attached to the distal end of the barrel. The suppressor includes a central chamber, configured along the bore axis which utilizes a plurality of suppressor baffles 21 to reduce the primary blast wave strength. A bypass chamber is located around the central core, where the inner surface of said bypass chamber is substantially defined by the exterior of the plurality of suppressor baffles. It may further include a plurality of baffles disposed substantially perpendicular to the bore axis, and also may take the form of bore rings or ported partitions, and where the fluid path defined by the baffled bypass chamber proceeds substantially forward. The bypass chamber provides for quicker blowdown of the barrel. This reduces blowback at the shooter's location as the breech cycles. There may be a distance within the can between the suppressor inlet at the distal end of the barrel and the proximal end of the central core chamber, said space provided by said distance may be referred to as the primary chamber and which space provides for fluid communication between the inlet and both the central chamber and the bypass chamber, which allows a portion of the expanding propellant gases to flow into the bypass chamber. A brake baffle 22 for redirecting the propellant gases is positioned subsequent to the plurality of suppressor baffles at the distal end of the suppressor. The brake baffle comprises a central chamber outlet disposed along the bore axis. While the plurality of suppressor baffles provide some braking, the function of the brake baffle is to redirect the propellant gases. Positioning the muzzle brake baffle subsequent to the plurality of the suppressor baffles lowers the pressure and flow rate of the gases entering the brake baffle. Further, the turning angle on the brake baffle is reduced to minimize the increase in blast overpressure at the shooter while still providing a counter recoil force. The brake baffle redirects the propellant gases out of openings or vents 14, 28-33 in the can, the vents or openings positioned in the portion of the can between the distal end of the plurality of suppressor baffles and the proximate end of the brake baffle. Advantageously, the openings or vents are located on the top and sides of the can and can thereby provide a net downward compensation force on the suppressed muzzle brake and hence on the end of the weapon when the propellant gases are propelled outward. This will reduce muzzle climb in the weapon. The turning angle of the brake baffle is determined in such a way as to not increase the pressure at the shooter's ear beyond allowable limits and noise levels. The brake baffle openings arrangement also serves to reduce ground obscuration by reducing the tendency to kick up dust.

In the embodiment shown in FIG. 2, there is not a separate chamber for the by-pass. In this embodiment, there are by-pass slots in the baffle but there is not a separate chamber volume for the core and by-pass holes.

Figure 3:
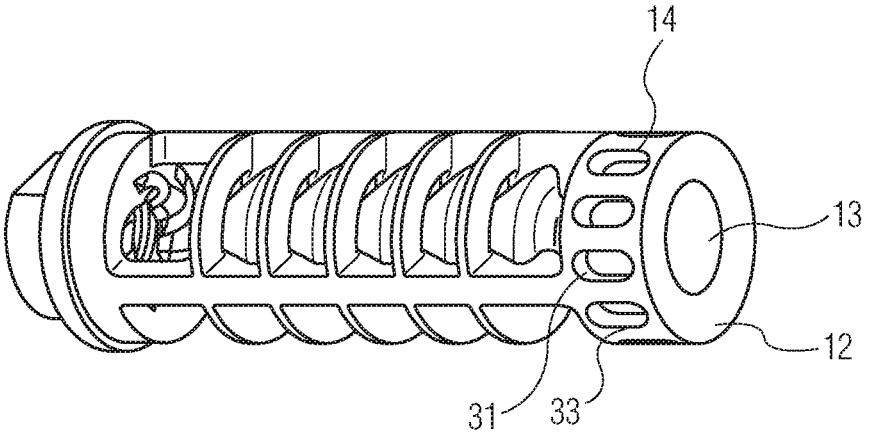
FIG. 3 shows a cut away view of a suppressed muzzle brake having vents at the distal end of the muzzle brake assembly, at the baffle brake area, in accordance with this invention.
Figure 4:
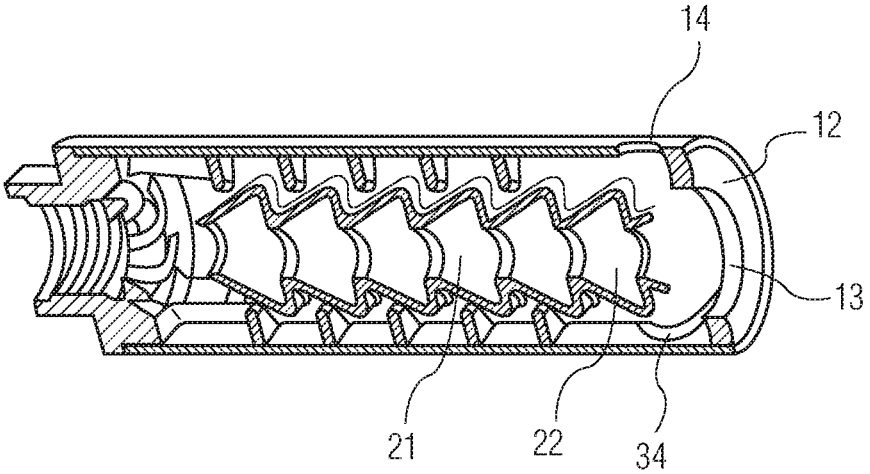
FIG. 4 shows a further cut away view of the suppressed muzzle brake having a baffle brake and vents at the distal end of the muzzle brake assembly, in accordance with this invention.

In FIG. 1, a suppressed muzzle brake 10 is shown for a weapon held by a shooter. The weapon has a barrel with a defined weapon longitudinal axis, and the suppressed muzzle brake has a defined muzzle brake longitudinal (Z direction) axis 17. The muzzle brake has means for coaxial attachment 11 at the muzzle end of the weapon. The muzzle brake also has a defined X-axis 24 and a defined Y-axis 23, and the muzzle brake comprises a mostly enclosed hollow cylindrical like can 10, having a closed muzzle end 12 except for a central hole 13 through which projectiles from the weapon may exit after having traversed the muzzle brake. The muzzle brake has a defined upper side 18, a defined upper right side 19, and a defined upper left side 25 from the shooter's perspective. The muzzle brake can, FIGS. 2, 3 and 4 for example, may comprise a central chamber, and include a stacked single filed plurality of suppressor baffles 21 in the can, a bypass chamber, and a final baffle being a brake baffle 22 located proximate the said closed muzzle end. The brake baffle has a turning angle designed to not further increase pressure at the ears of the shooter. The brake baffle further comprises directed openings or vents 14 formed at the upper side 18 at the distal end of said can, each said opening or vent having a floor opening 26 and a slanted surface 15 angled in a direction backwards towards the shooter but at an acute angle 'R' with respect to the muzzle brake longitudinal axis. (see FIGS. 5A-5C. FIG. 5A shows a cross section of vent opening 14; FIG. 5B shows a top view of vent opening 14; and, FIG. 5C shows another cross section of vent opening 14). This produces a force component backwards along the Z longitudinal axis direction and a force component downward along the Y-axis direction. The vents are positioned at the location of the most distally located, end suppressor baffle 22. At the top most side 18 of the muzzle brake with respect to the muzzle brake longitudinal axis is vent 14, but vents 28-34 may also be present (see FIG. 6). Gas pressures escaping from the vents tend to produce a counter recoil force on the weapon. Some of the vents could also correct for muzzle climb by providing a net downward force at the end of the weapon. The vents could also reduce ground obscuration by reducing the tendency to kick up dust. The vents will also reduce blast overpressure experienced by the shooter beyond what the suppressed muzzle brake would accomplish without the brake baffle and its directed vents. The vents on the sides of the muzzle suppressor may produce X-axis components of force with respect to the muzzle brake longitudinal axis. While positioned at the location of the most distally located end suppressor baffle the two side forces may be balanced so as not to tend to turn the weapon.

FIG. 7A shows a top down isometric view of the suppressed muzzle brake in accordance with this invention; FIG. 7B shows a cross-sectional view of the suppressed muzzle brake in accordance with this invention; FIG. 7C is an end view, from the muzzle end, of the suppressed muzzle brake in accordance with this invention; FIG. 7D is an exterior view of the baffle brake elements located within the muzzle end of the suppressed muzzle brake in accordance with this invention; FIG. 7E is an end view, from the muzzle end, of the baffle brake elements shown in FIG. 7D hereof; FIG. 7F is a right leaning, top down isometric view of the suppressed muzzle brake in accordance with this invention; FIG. 7G is a front view of the suppressed muzzle brake in accordance with this invention, and; FIG. 7H is a cross-sectional view of the baffle brake elements located within the muzzle end of the suppressed muzzle brake in accordance with this invention.

While the invention has been described with reference to certain embodiments, numerous changes, alterations and modifications to the described embodiments are possible without departing from the spirit and scope of the invention as defined in the appended claims, and equivalents thereof.

What is claimed is:

1. A brake baffle for a suppressed muzzle brake for a weapon held by a shooter, a weapon having a barrel with a defined weapon longitudinal axis, and a muzzle brake having a defined muzzle brake longitudinal axis (17), and said muzzle brake having means for coaxial attachment (11) at a muzzle end of said weapon, said muzzle brake also having a defined X-axis (24) and a defined Y-axis (23), said muzzle brake comprising a mostly enclosed hollow cylindrical like can (10), having a closed muzzle end (12) except for a central hole (13) through which projectiles from the weapon may exit after traversing said muzzle brake, a defined upper side (18) of the muzzle brake, a defined upper right side (19) and a defined upper left side (25) from a shooter's perspective, of the muzzle brake, and which said muzzle brake can comprises a central chamber, and includes a stacked single filed plurality of suppressor baffles in said can, a bypass chamber, and a final baffle of said plurality being a brake baffle located proximate the said closed muzzle end, and wherein said brake baffle has a turning angle designed to not further increase pressure at the ears of the shooter, and wherein said brake baffle further comprises directed vents (14) formed in the can's periphery at the upper side (18) at a distal end of said can, at the brake baffle's location, each said vent angled (15) in a direction backwards towards the shooter but at an acute angle 'R' with respect to the muzzle brake longitudinal axis.

2. The brake baffle according to claim 1 wherein gases escaping from the directed vents produce a force component backwards along a Z longitudinal axis direction which tend to produce a counter recoil force on the weapon.

3. The brake baffle according to claim 1 wherein gases escaping from the directed vents produce a force component downward along the Y-axis direction which tends to counter muzzle climb of the weapon.

4. The brake baffle according to claim 1 wherein gases escaping from the directed vents will reduce blast overpressure experienced by the shooter beyond what the suppressed muzzle brake would accomplish without the brake baffle directed vents.

5. The brake baffle according to claim 1 wherein gases escaping from some directed vents also can reduce ground obscuration by reducing the tendency to kick up dust, beyond what the suppressed muzzle brake would accomplish without the brake baffle directed vents.

6. The brake baffle according to claim 1 wherein gases escaping from some directed vents also can be used to produce force components in side directions along the X-axis.

* * * * *